United States Patent [19]

Yonovich

[11] Patent Number: 4,685,175

[45] Date of Patent: Aug. 11, 1987

[54] SPRING SYSTEM FOR DOUBLE-HUNG WINDOW SASH

[75] Inventor: John R. Yonovich, Shortsville, N.Y.

[73] Assignee: Caldwell Manufacturing Company, Rochester, N.Y.

[21] Appl. No.: 771,350

[22] Filed: Aug. 30, 1985

[51] Int. Cl.[4] ..... E05F 1/08

[52] U.S. Cl. ..... 16/197; 16/193; 49/446; 49/429

[58] Field of Search ..... 16/193, 197, DIG. 42; 49/445, 446, 428–431

[56] References Cited

U.S. PATENT DOCUMENTS

| | | | |
|---|---|---|---|
| 2,722,723 | 11/1955 | Mears, Jr. | 49/430 |
| 2,848,760 | 8/1958 | Hettinger et al. | 49/429 |
| 2,869,184 | 1/1959 | Zegers | 49/430 |
| 3,375,610 | 4/1968 | Beasley, Jr. et al. | 49/445 |
| 3,466,806 | 9/1969 | Teggelaar et al. | 49/445 |
| 4,571,887 | 2/1986 | Haltof | 16/197 |

*Primary Examiner*—Donald R. Schran
*Assistant Examiner*—James L. Wolfe
*Attorney, Agent, or Firm*—Stonebraker, Shepard & Stephens

[57] ABSTRACT

A window spring system for jamb liners 10 having a guide rails 11 formed in sash run regions 12 includes a spring 40, spring cover 60, spring anchorage 30, and sash platform 50 assembled within spring cover 60 that encloses spring 40 and has a closed back side 61 formed with opposite guide edges 62 shaped to slide into an interlock with guide rails 11 in jamb liner 10. An upper region 66 of the back side of spring cover 60 is cut away to receive spring anchorage 30, which is connected to an upper region of spring 40 and engages spring cover 60 and jamb liner 10 and preferably interlocks with jamb liner guide rails 11. A lower region 67 of the back side of spring cover 60 is cut away to receive sash platform 50 connected to a lower region of spring 40 and also preferably interlocking with guide rails 11 of jamb liner 10.

13 Claims, 6 Drawing Figures

SPRING SYSTEM FOR DOUBLE-HUNG WINDOW SASH

BACKGROUND

Counterbalance springs for double-hung window sash have been stretched between an anchorage at the top of a jamb liner and a platform engaging a lower corner of the sash, and a cover attached to the jamb liner has concealed the spring in the upper half of the sash run. Especially for jamb liners and spring covers formed of extruded resin material, a desirable way of attaching the spring cover to the jamb liner has been by interlocking opposite back edges of the spring cover with a pair of guide rails extending along the sash run of the lamb liner. Such spring systems have been assembled with jamb liners for shipment to window manufacturers who install the jamb liners and spring system within a window frame containing double-hung window sash.

The covers of such window balance spring systems sometimes come loose from the guide rails in the jamb liners and require laborious reattachment. This can sometimes happen even after the complete window assembly is installed in a building.

I have devised a simple, low cost, and effective way of preventing the spring cover from coming loose from the jamb liner, and my solution for this problem has led to unexpected additional advantages. For example, window counterbalance spring systems can be subassembled into my improved spring cover, which reliably holds all the components together and participates in the secure attachment of all the components to a jamb liner. My invention thus saves labor costs, makes manufacturing assembly more efficient, and eliminates losses from spring covers working loose from jamb liners.

SUMMARY OF THE INVENTION

My spring system for window sash includes a spring, spring cover, spring anchorage, and sash platform fitted to a jamb liner having guide rails extending along its sash run regions. Spring covers according to my invention substantially enclose the spring and have a closed back side formed with opposite guide edges shaped to slide into an interlock with the guide rails in the sash runs of the jamb liner, the closed back side of the spring covers ensuring that its interlocked edges cannot work loose from the guide rails.

Upper and lower regions of the back side of my spring cover are cut away for respectively receiving a spring anchorage and a sash platform. The cutaway regions of the spring cover allow a coiled tension spring with a sash platform attached to its lower end to be slid up through the spring cover to extend above the upper end of the spring cover so that a spring anchorage can be attached to an upper region of the spring and interlocked with the spring cover. The sash platform can then be pulled down along the lower cutaway region to engage the lower end of the spring cover and complete a subassembly held taut by the tension of the spring stretched between the anchorage and the platform. When the subassembly of spring cover, spring, anchorage, and platform is slid into an interlock with the guide rails of a jamb liner, the anchorage overlaps the upper end of the jamb liner and has opposite edges that interlock with the guide rails, and the sash platform also has opposite edges interlocking with the guide rails, besides engaging a lower region of a sash.

The end result is that all the components are neatly and reliably interlocked with each other, both in a subassembly state and in a fully assembled interlock with a jamb liner. This reduces assembly labor, eliminates reassembly labor from components coming apart, and forms a sturdy and reliable counterbalance spring system.

DRAWINGS

DETAILED DESCRIPTION

Figure 1:
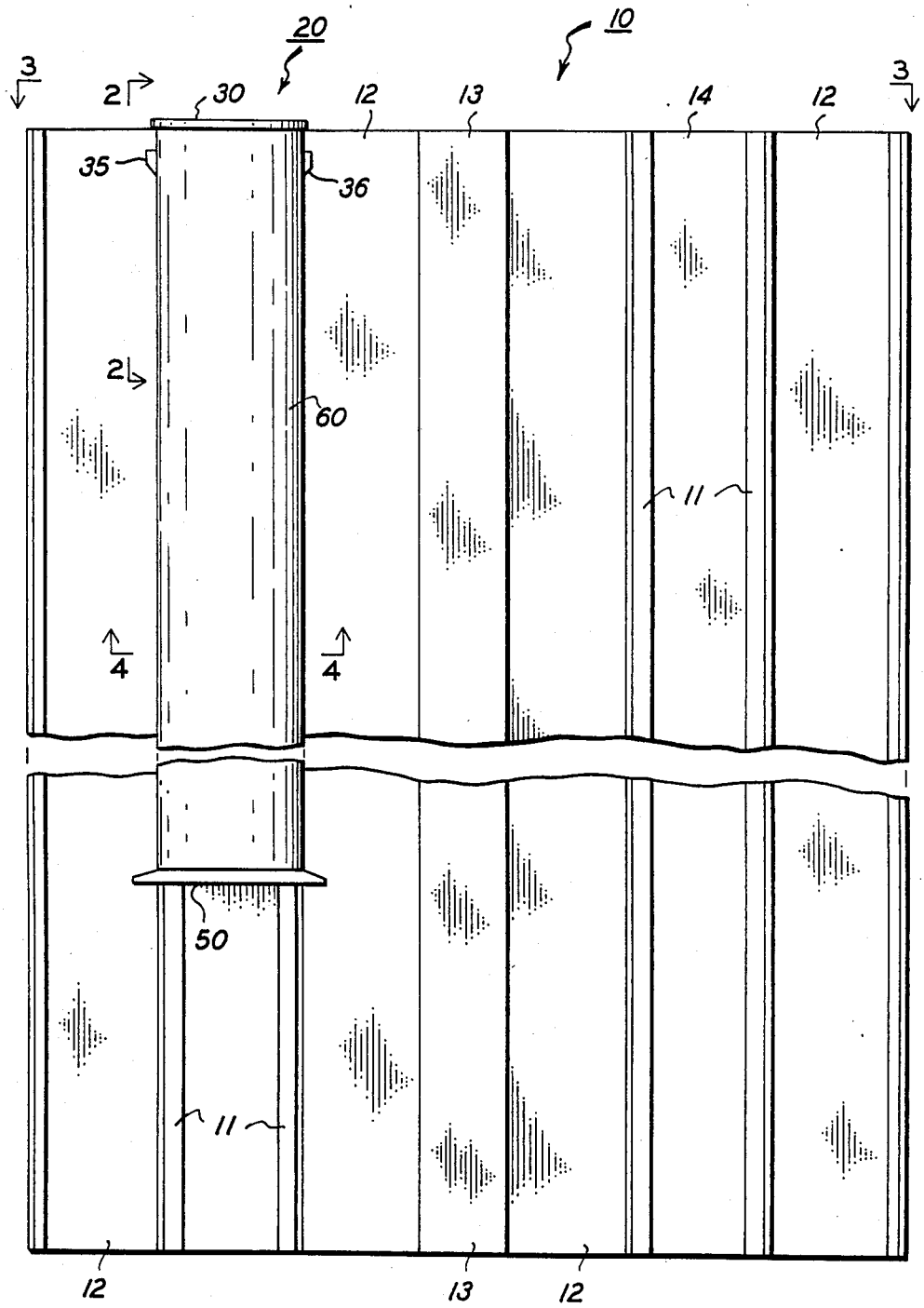
FIG. 1 is a fragmentary elevational view of a preferred embodiment of a counterbalance spring system according to my invention assembled onto a jamb liner having guide rails in sash run regions.

My invention applies to a counterbalance spring system for windows that include a jamb liner 10 having guide rails 11 in sash run regions 12 separated by parting bead 13. A sash (not shown) for such windows can be double or single hung and made of various materials. A counterbalance spring 40 for a movable sash for such a window is enclosed within a spring cover 60, which is attached to jamb liner 10 by an interlock with guide rails 11. For double-hung windows, spring covers 60 extend from the top of jamb liner 10 down to a mid-region of jamb liner 10 to cover springs 40 in the upper halves of each of the sash runs 12. Springs 40 extend between an anchorage 30 at the top of spring cover 60 and jamb liner 10 and a sash platform 50 disposed for engagement with a lower corner of a sash movable up and down in sash run 12.

Spring 40, with anchorage 30 connected to an upper end and platform 50 connected to a lower end, can be contained within spring cover 60 to form a subassembly 20 that can be slid into a secure interlock with guide rails 11 for mounting balance spring subassemblies 20 on jamb liner 10. Spring 40 is preferably a coiled tension spring suitably sized so that a pair of springs 40 connected to platforms 50 at opposite lower corners of a sash provide sufficient upward spring force to counterbalance the weight of the sash so that the sash will stay at different elevations within sash run 12.

Figure 3:
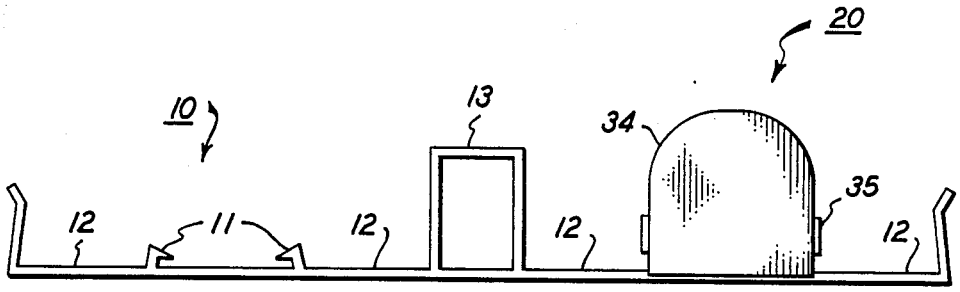
FIG. 3 is a partially cutaway top view of the system of FIG. 1.
Figure 2:
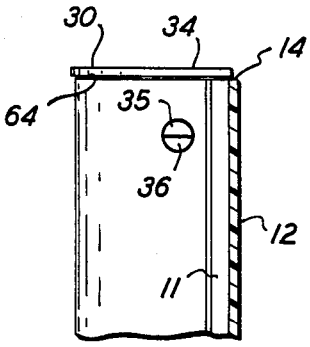
FIG. 2 is a fragmentary cross-sectional view of the system of FIG. 1, taken along the line 2—2 thereof.
Figure 4:
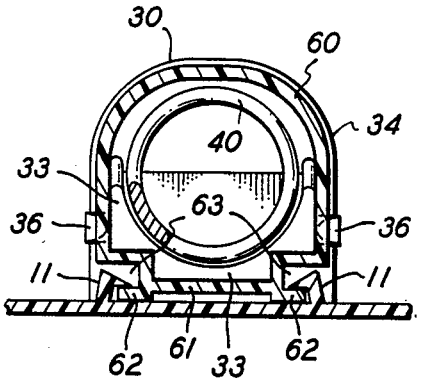
FIG. 4 is a fragmentary cross-sectional view of the system of FIG. 1, taken along the line 4—4 thereof.

Guide rails 11 are preferably L-shaped in cross section as best shown in FIGS. 3 and 4 and extend away from sash run 12 and toward each other to form a T-shaped interlock channel between guide rails 11. Spring covers have been made with open backs and opposite back edges shaped to interlock with guide rails 11; but since such spring covers were flexible, their opposite locking edges could be squeezed toward each other and come loose from their interlock with guide rails 11.

My invention solves this problem by forming spring cover 60 as an enclosed, D-shaped tube having a back side that is closed by a resin wall 61 extending between opposite edges 62 shaped to slide between and interlock with guide rails 11. Since spring cover 60 is preferably extruded of resin material, adding closed back side wall 61 between guide edges 62 uses only a small additional amount of resin material, which braces against or blocks any inward movement of guide edges 62. Since edges 62 cannot be squeezed together, they are securely trapped in an interlock with guide rails 11 so that spring cover 60 cannot separate from jamb liner 10 once its guide edges 62 are interlocked with guide rails 11.

Grooves 63 formed in opposite side walls of spring cover 60 adjacent guide edges 62 receive the in-turned portions of L-shaped guide rails 11. Spring cover 60 can be slid longitudinally into an interlocked attachment with jamb liner 10 by sliding guide edges 62 in between guide rails 11, which is accommodated by the reception of the in-turned portion of guide rails 11 in spring cover grooves 63.

I prefer that spring anchorage 30 also interlock with guide rails 11 in jamb liner 10, and I provide anchorage 30 with opposed guide edges 31 and 32 for this purpose. Anchorage 30 has a wedge connector (not shown) that attaches to spring 40 in the region between guide edges 31 and 32, and the top 34 of spring anchorage 30 is shaped to overlap and abut against the top 64 of spring cover 60 and the top 14 of jamb liner 10.

The body 33 of anchorage 30 not only connects to spring 40, but fits within the upper end of spring cover 60. A pair of stubs 35 having sloped lower surfaces 36 extend outward from opposite sides of anchorage body 33 where they slide into an interlock with holes 65 in the side walls of spring cover 60. This latches anchorage 30 in place in the upper region of spring cover 60 so that anchorage top 34 engages both the top edge 64 of cover 60 and the top edge 14 of jamb liner 10. Opposing guide edges 31 and 32 of anchorage 30 slide into an interlock with guide rails 11 and form a secure interconnection between anchorage 30, spring cover 60, and jamb liner 10.

I also prefer a wedge connector for interconnecting platform 50 with a lower end of spring 40. Platform 50 includes a carriage 51 that fits within spring cover 60 and has runners 52 with opposite edges 53 that interlock with and run within guide rails 11 of jamb liner 10. Although a suitable platform 50 can have many different forms, the illustrated and preferred platform 50 includes a friction shoe 54 that presses against the region of the sash run between guide rails 11 and has opposite edges 55 that also interlock under guide rails 11.

Figure 5:
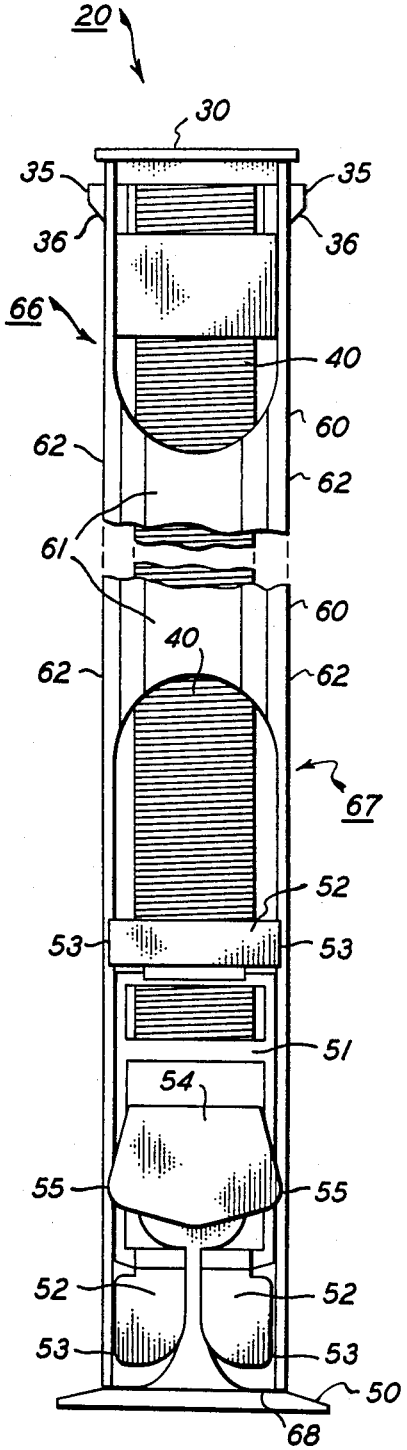
FIG. 5 is an enlarged, fragmentary back view of a subassembly of spring cover, spring, anchorage, and sash platform as used in FIGS. 1–4.
Figure 6:
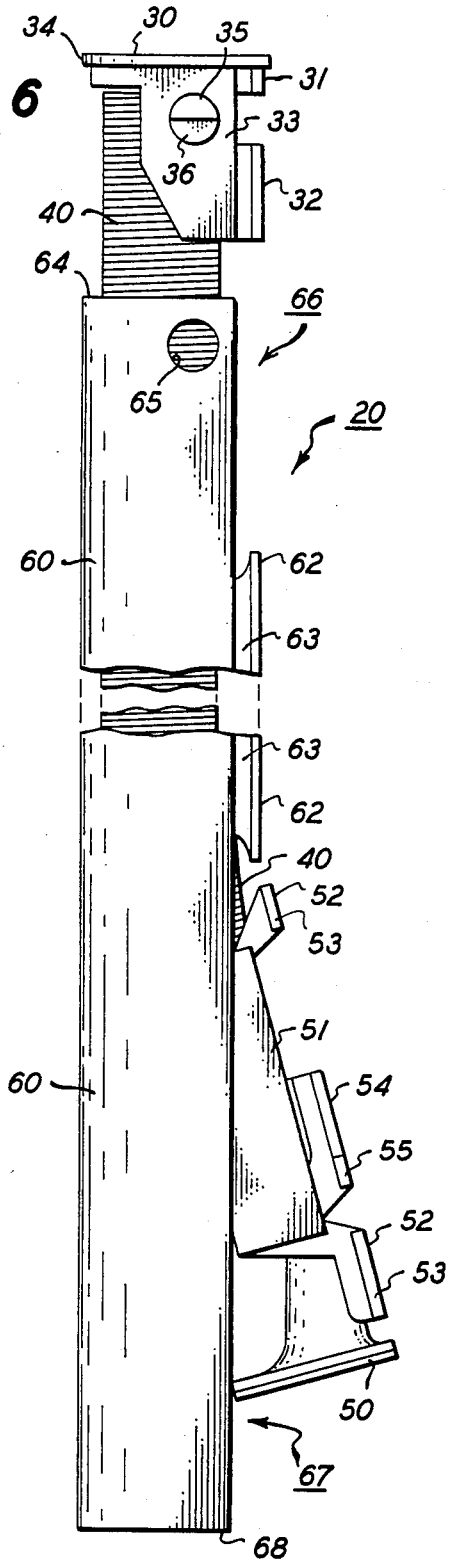
FIG. 6 is a fragmentary side elevational view of the subassembly of FIG. 5 positioned for attaching a spring anchorage to the counterbalance spring.

To accommodate the interlocking of anchorage 30 and platform 50 with guide rails 11, upper and lower regions of spring cover 60 are cut away at the closed back side of spring cover 60 as best shown in FIGS. 5 and 6. Cutaway upper region 66 accommodates opposite guide edges 31 and 32 of anchorage 30, which can be slid into and interlocked with guide rails 11. Cutaway lower region 67 of spring cover 60 accommodates runners 52 and 53 of platform carriage 51 and friction shoe 54, all interlocking with guide rails 11. Cutaway regions 66 and 67 are formed quickly and economically with a router device after an extrusion is cut to the length of spring cover 60.

Cutaway lower region 67 is made to extend from the bottom 68 of spring cover 60 for a distance considerably longer than platform 50. This facilitates assembly of platform 50, spring 40, and anchorage 30 within spring cover 60 to form subassembly 20 as explained below.

After spring cover 60 is cut to length from a longer extrusion and back side regions 66 and 67 are cut away from cover 60, a preferred way of assembling the components for subassembly 20 is to attach spring 40 to platform 50 and slide spring 40 through spring cover 60 until platform 50 reaches the limit of travel allowed by cutaway region 67 as shown in FIG. 6. This advances spring 40 beyond the top end 64 of spring cover 60 where anchorage 30 can be attached to the upper end of spring 40. Anchorage 30 is then pressed down into the upper region of spring cover 60 to snap stubs 35 into place in holes 65. Then platform 50 is pulled downward into engagement with bottom 68 of spring cover 60 as shown in FIG. 5. This tensions spring 40, which is stretched between anchorage 30 and platform 50 and housed within closed spring cover 60. The spring tension helps keep platform 50 in snug engagement with bottom 68 of spring cover 60.

If platform 50 is knocked loose from spring cover bottom 68, the subassembly components do not separate or fly apart, as would happen with previous spring covers lacking closed back sides. The closed D-tube shape of spring cover 60 prevents any separation of spring 40, anchorage 30, and platform 50. Both anchorage 30 and platform 50 are securely connected to opposite ends of spring 40 and cannot pass through the closed mid-section of spring cover 60.

The ability of my invention to accommodate subassembly 20 of spring cover 60, spring 40, anchorage 30, and platform 50 as unseparable components facilitates manufacturing by allowing such subassemblies to be prepared separately of the final assembly onto jamb liner 10. This only requires sliding the proper subassembly 20 downward into sash runs 12 of a jamb liner 10 so that all the guide edges 53, 62, 32, and 31 all slide into an interlock with guide rails 11, leaving anchorage top 34 abutted against the top 14 of jamb liner 10. A sash can then rest on a pair of platforms 50 and be counterbalanced by a pair of springs 40.

I claim:

1. A window spring subassembly for a double sash window system having guide rails formed in sash run regions of jamb liners, said subassembly comprising:

a. a spring, a spring cover, a spring anchorage, and a sash platform;

b. said spring cover substantially enclosing said spring and having a closed back side formed with opposite guide edges shaped to slide into an interlock with said guide rails;

c. an upper region of said back side of said spring cover being cut away to receive said spring anchorage connected to an upper region of said spring;

d. a lower region of said back side of said spring cover being cut away to receive said sash platform connected to a lower region of said spring and tensioning said spring between said anchorage and said platform; and e. a cutaway lower region extending far enough above a lower end of said spring cover so that said platform can move above said lower end of said spring cover to position said upper region of said spring above an upper end of said cover for attaching said anchorage to said spring.

2. The subassembly of claim 1 wherein said anchorage has opposite guide edges shaped to interlock with said guide rails and an upper edge that overlaps an upper end of said jamb liner.

3. The subassembly of claim 2 wherein said anchorage has laterally extending stubs that engage holes formed in sides of an upper region of said cover.

4. The subassembly of claim 1 wherein said platform has opposite guide edges shaped to interlock with said guide rails.

5. The subassembly of claim 4 wherein said spring cover has opposed grooves proximate to said back side to provide said guide edges.

6. In a spring system for a double sash window having jamb liners with guide rails in sash run regions, said spring system including a spring, spring cover, spring anchorage, and sash platform, the improvement comprising:

a. said spring cover enclosing said spring and having a closed back side formed with opposite edges that interlock with said guide rails, said closed back side being flat in a region between said opposite edges;

b. said anchorage having opposite edges that interlock with said guide rails in a cutaway upper region of said cover and having a top that engages upper edges of said cover and said jamb liner; and c. said platform having opposite guide edges that interlock with said guide rails in a cutaway lower region of said cover extending far enough above a lower end of said spring cover so that said platform can move above said lower end of said spring cover to position said upper region of said spring above an upper end of said cover for attaching said anchorage to said spring.

7. The improvement of claim 10 wherein said spring is tensioned between said anchorage and said platform when said platform engages a lower end of said spring cover.

8. The improvement of claim 6 wherein an upper region of said cover has opposed holes, and said anchorage has opposed stubs extending through and interlocking with said holes.

9. A method of assembling a spring system for a double sash window, said method comprising:

a. connecting a sash platform to a balance spring;

b. sliding said balance spring through a closed spring cover that allows said platform to advance beyond a lower end of said spring cover to extend said spring above an upper end of said spring cover;

c. attaching a spring anchorage to an upper region of said spring;

d. connecting said anchorage to an upper region of said cover; and e. engaging said platform with said lower end of said cover to tension said spring between said anchorage and said platform to form a subassembly for said window system.

10. The method of claim 9 including sliding said subassembly into an interlocking relationship with guide rails formed in sash runs of jamb liners for said window assembly.

11. The method of claim 10 including interlocking opposite guide edges of said sash cover, said anchorage, and said platform with said guide rails.

12. The method of claim 11 including engaging an abutment of said anchorage against an upper edge of said jamb liner.

13. The method of claim 11 including interlocking opposed stubs of said anchorage with holes in opposite sides of an upper region of said cover.

* * * * *